US009004391B2

(12) United States Patent
Fernandez

(10) Patent No.: US 9,004,391 B2
(45) Date of Patent: Apr. 14, 2015

(54) APPARATUS FOR HAND WINDING A HOSE LINE

(75) Inventor: Javier Fernandez, Mukwonago, WI (US)

(73) Assignee: Roll n Rack LLC, Mukwonago, WI (US)

( * ) Notice: Subject to any disclaimer, the term of this patent is extended or adjusted under 35 U.S.C. 154(b) by 666 days.

(21) Appl. No.: 13/018,865

(22) Filed: Feb. 1, 2011

(65) Prior Publication Data

US 2012/0193465 A1 Aug. 2, 2012

(51) Int. Cl.

| | |
|---|---|
| ***B65D 85/671*** | (2006.01) |
| ***B65H 75/28*** | (2006.01) |
| ***B65H 75/44*** | (2006.01) |

(52) U.S. Cl.

CPC ..... *B65H 75/28* (2013.01); *B65H 75/4492* (2013.01); *B65H 2301/5115* (2013.01); *B65H 2701/33* (2013.01); *B65H 2701/332* (2013.01)

(58) Field of Classification Search

USPC ..... 242/405, 405.3, 588, 588.2, 588.3, 242/588.6

See application file for complete search history.

(56) References Cited

U.S. PATENT DOCUMENTS

| | | | | |
|---|---|---|---|---|
| 3,722,823 | A * | 3/1973 | Reich et al. | 242/396.9 |
| 4,198,010 | A * | 4/1980 | Knapp | 242/532.6 |
| 4,280,672 | A * | 7/1981 | Santos et al. | 242/534.2 |
| 4,892,265 | A * | 1/1990 | Cox | 242/539 |
| 4,978,100 | A * | 12/1990 | Peurifoy | 251/8 |
| 5,388,609 | A * | 2/1995 | Ghio et al. | 137/355.27 |
| 5,421,533 | A * | 6/1995 | Scott et al. | 242/405.3 |
| 5,505,404 | A | 4/1996 | Dubreuil | |
| 5,566,901 | A | 10/1996 | Wilder | |
| 6,811,110 | B2 | 11/2004 | Tsao | |
| 7,661,683 | B2 * | 2/2010 | Fernandez | 280/47.24 |
| 8,955,786 | B2 * | 2/2015 | Motoji et al. | 242/391.2 |
| 2004/0089761 | A1 * | 5/2004 | Tsao | 242/530.2 |
| 2009/0121067 | A1 * | 5/2009 | Arcati et al. | 242/395 |

FOREIGN PATENT DOCUMENTS

| | | | |
|---|---|---|---|
| AU | 2008902701 | A1 * | 5/2008 |
| WO | WO 2009143919 | A1 * | 12/2009 |

* cited by examiner

*Primary Examiner* — Emmanuel M Marcelo
*Assistant Examiner* — Angela Caligiuri
(74) *Attorney, Agent, or Firm* — Joseph S. Heino; Patrick M. Bergin

(57) ABSTRACT

An apparatus for winding a hose line having a threaded male end. The apparatus comprises a frame that has a first side plate, a second side plate and means for positioning the side plates apart from one another. The first side plate has a circular aperture and a center assembly having a handle crank, a revolving handle and means for rotating the center assembly within the first side plate aperture when the handle crank is rotated by hand. A coupling jaw assembly is also provided and has a fork that is removably insertable into the center assembly to capture the threaded male end of the hose line. Rotation of the handle crank then winds the hose line to form a coiled hose within the apparatus. The coiled hose can be transported within the apparatus or can be left standing upright when released from the apparatus.

14 Claims, 4 Drawing Sheets

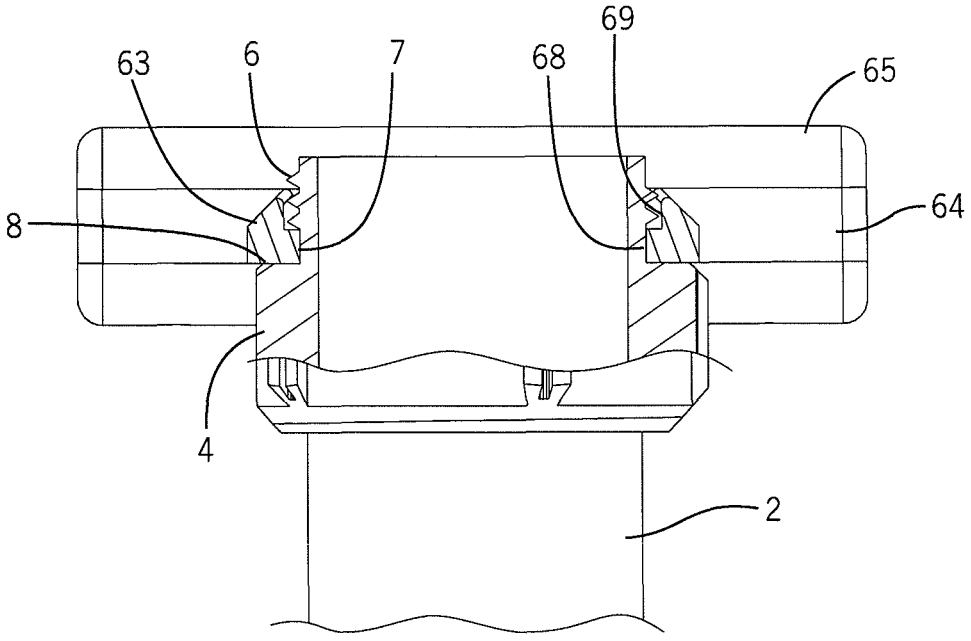
FIG. 5
FIG. 6
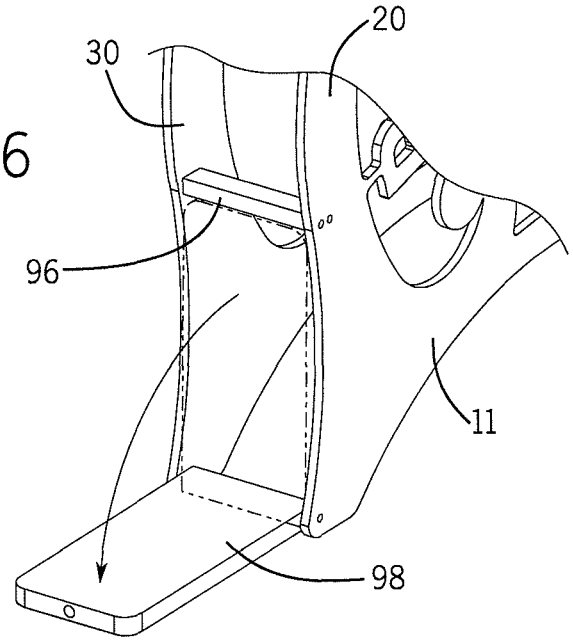

APPARATUS FOR HAND WINDING A HOSE LINE

FIELD OF THE INVENTION

The present invention relates generally to devices for winding hoses, and fire hoses in particular. More specifically, it relates to an apparatus that can be used, by hand, to wind a hose line into a coil. Once wound, the apparatus releases the coiled hose line and leaves it standing upright in a given location for further tending by a user. The apparatus can also be used to aid a firefighter in lifting and carrying the coiled fire hose line to a fire truck prior to releasing the coiled hose line from the apparatus.

BACKGROUND OF THE INVENTION

The use of water hoses in the art of firefighting is well known. Water sprayed onto a fire extinguishes the fire and saturates the surrounding area, thereby impeding the spreading of the fire. Since most fires occur in areas that are not close to a water supply, the water supply must be brought to the fire location. This is accomplished by using one or more fire hoses. The typical connection of a fire hose line is to attach it to a fire truck that is in proximity to the fire. The truck is then, in turn, connected to a fire hydrant which provides the source for the water. The distal end of the fire hose is connected to a nozzle that is adapted for spraying water at a variable quantity and rate that is suitable for the fire being fought. There may be more than one hose used, in which case each is connected to the end of the other. The scope of the present invention is that it is intended to be used with hand lines that are typically 1.5 in. to 1.75 in. diameter fire hose lines or with 1.5 in. or smaller forestry lines. Such hoses will be collectively, but singularly, designated simply as "hose" or "hose line" throughout this application. The hose line is typically fabricated of a flexible material. This is to allow the hose to expand when filled with pressurized water, during which the hose line assumes a substantially round or oblate cross-sectional configuration. When the hose line is not filled with water, it flattens out and has virtually no cross-sectional opening in it. In this flattened state, the hose line is able to be rolled into a substantially more compact coil. This coil can then be stood on end, in a concentrically layered and wheel-like fashion.

A common hose line length is 50 ft. and may have any number of lengths coupled together and is deployed from the fire truck for firefighting operations. Forestry lines can be 100 ft. in length and many similarly have any number of lengths coupled together. During its deployment from the bed or deck of a fire truck, the hose line is pulled and laid out on the ground, in line with other like segments of hose line and in a generally straight and flat position. The hose lines are connected and then pressurized with water, the end of the hose line being fitted with a nozzle. After use, the hose lines must be collected, drained, transported back to the fire truck and re-stored on the deck of the fire truck for later re-use.

This inventor has previously devised a patented apparatus for draining, winding and transporting large diameter hoses of the type described above. That device is disclosed and claimed in U.S. Pat. No. 7,661,683 and includes a frame and retractable handle. The frame is movable by virtue of a pair of wheels attached to the bottom-most portion of the frame. The frame is configured such that the center of gravity of the frame, and of the frame and a coiled hose line situated on it, is located directly above the wheels. The frame includes a number of horizontally disposed rollers that facilitate removal of the hose line coil from the frame when the hose line is being re-stacked onto the fire truck. The frame also includes a guide bar to assist in maintaining the hose line coil in an upright position during transport. The frame also utilizes other features and attachments.

Notwithstanding the advantages of the aforementioned patented device, this inventor believes that there is a need for an additional compact and portable apparatus that facilitates the winding-up of the hose line into a coil and allows the coil to be easily removed from the apparatus when winding is completed. What is also needed is such an apparatus that will accommodate hose lines of varying diameter and length, will be lightweight and relatively compact, and will be easy to use in the field.

SUMMARY OF THE INVENTION

Accordingly, a primary object of the present invention is to provide a new, useful and non-obvious apparatus for facilitating the winding-up of a hose line into a coil. It is another object to provide such an apparatus that allows the coil to be easily removed from the apparatus when winding is completed. It is still another object to provide such an apparatus that will accommodate hose lines of varying diameter and length. It is yet another object to provide such an apparatus that will be lightweight and relatively compact, and easy to use in the field. It is still another object to provide such an apparatus that provides means for removing debris from the hose line as it is wound within the apparatus.

In accordance with the aforementioned objectives of the present inventions, there is provided an improved apparatus for winding and transporting hose lines of the type that are used in fire fighting. The apparatus includes a frame and a handle. The frame comprises a pair of vertical and parallel plates disposed a distance from one another. The frame further comprises a center assembly and a coupling jaw assembly. The coupling jaw assembly allows one end of a hose line to be removably engaged by a fork-like jaw. A kneeling plate is rotatable such that the user can place his or her knee on the plate to maintain the position of the frame during use of the apparatus. A rotatable handle is provided such that rotation of the handle also rotates the fork-like jaw and the hose end engaged by it. Rotation of the handle pulls the hose line into the apparatus and allows the hose line to be coiled within the frame. Additional structure is provided to properly guide the hose line into the frame during winding and to brush the hose line free of debris. It the user wants to transport the coiled hose line within the frame, the user grabs the handle and moves the frame with the coiled hose line contained within it. If the user wants to simply leave the coiled hose line, the fork-like jaw is removed from the center assembly and the frame is elevated, leaving the coiled hose line in that location, the frame having an open bottom.

The foregoing and other features of the apparatus of the present invention will be apparent from the detailed description that follows.

BRIEF DESCRIPTION OF THE DRAWINGS

FIG. 5 is a partially cross-sectioned view of the fork and male coupling end shown in FIG. 4 and taken along line 5-5 thereof.

FIG. 6 is a partial top, rear and left side perspective view of the apparatus shown in FIG. 1 but illustrating the kneeling plate in its lowered position such that a user can position his or her knee on the plate to maintain position of the apparatus during use.

DETAILED DESCRIPTION

Figure 1:
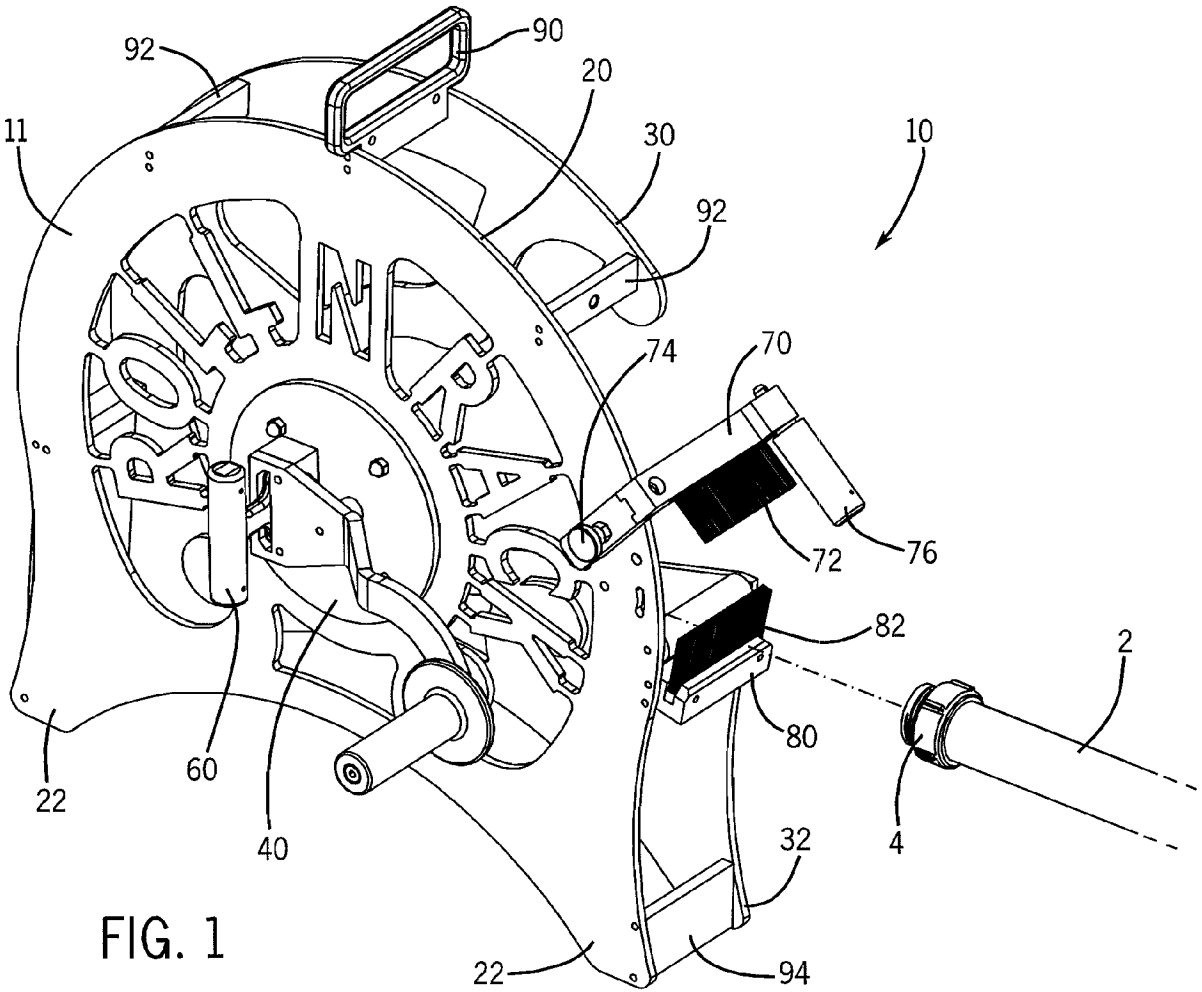
FIG. 1 is a front, top and left side perspective view of an apparatus for hand winding and transporting hose line that is constructed in accordance with the present invention.

Referring now to the drawings in detail, wherein like numbered elements refer to like elements throughout, FIG. 1 illustrates a large diameter hose hand winding apparatus, generally identified 10, that is constructed in accordance with the present invention. The apparatus 10 is comprised generally of a frame 11 that is constructed from a first side plate 20, a second side plate, and a plurality of cross blocks 92, 94 disposed between the side plates 20, 30. Each plate 20, 30 is generally configured in a semi-circular pattern along the top of the plate 20, 30 with feet 22, 32 being disposed at a generally flat or slightly arcuate bottom of each plate 20, 30, respectively. This provides stability to the apparatus 10 insofar as each side plate 20, 30 stands in a vertical plane, with the planes of each being in parallel to one another. The apparatus 10 further comprises a center assembly 40, a coupling jaw assembly 60, a structural configuration for guiding a hose line 2 as the hose line 2 is wound into the frame of the apparatus 10, a structural configuration for maintaining the position of the apparatus 10 as the hose line 2 is pulled towards it, and a carrying handle 90.

Continuing with FIG. 1, it will be seen that the uppermost cross blocks 92, which are those that are disposed closest to the carrying handle 90, are capable of being used with a carrying strap (not shown) that can be attached to the cross blocks 92 for ease in transporting the apparatus 10. A bottom cross block 94 is disposed forwardly of the frame near each one of the feet 22, 32 of each plate 20, 30. Rearward of the bottom cross block 94 is a cross block 96 and a kneeling plate 98 (see FIG. 6) the functionality of which will be described later in this detailed description. Suffice it to say that the cross blocks 92, 94, 96 are intended to space and support the plates 20, 30 apart in their parallel planar positions and are also intended to maintain the plates 20, 30 in that position, providing structural integrity to the frame.

Though not shown, the first side plate 20 includes a centrally-disposed circular aperture. This aperture allows the center assembly 40 to be secured to the plate 20 as will be described as follows, with particular reference to FIG. 2, which is an exploded view of the center assembly 40 and the coupling jaw assembly 60. As shown, the center assembly 40 comprises a crank side center disk 42 and a hose side center disk 44. The diameter of each disk 42, 44 is larger than the diameter of the centrally-disposed circular aperture defined within the first side plate 20. The center disks 42, 44 are separated by a plurality of disk spacers 46 and wheels 48, the wheels 48 being mounted to the spacers 46 in a rotatable fashion and each spacer 46 being a washer-like structure. The spacers 46 are used to space the disks 42, 44 away from one another by a distance that is slightly more than the thickness of the first side plate 20. The spacers 46 and the wheels 48 that surround them are held in position relative to the disks 42, 44 using fasteners 45, but with the wheels 48 being fully rotatable about the spacers 46.

Figure 2:
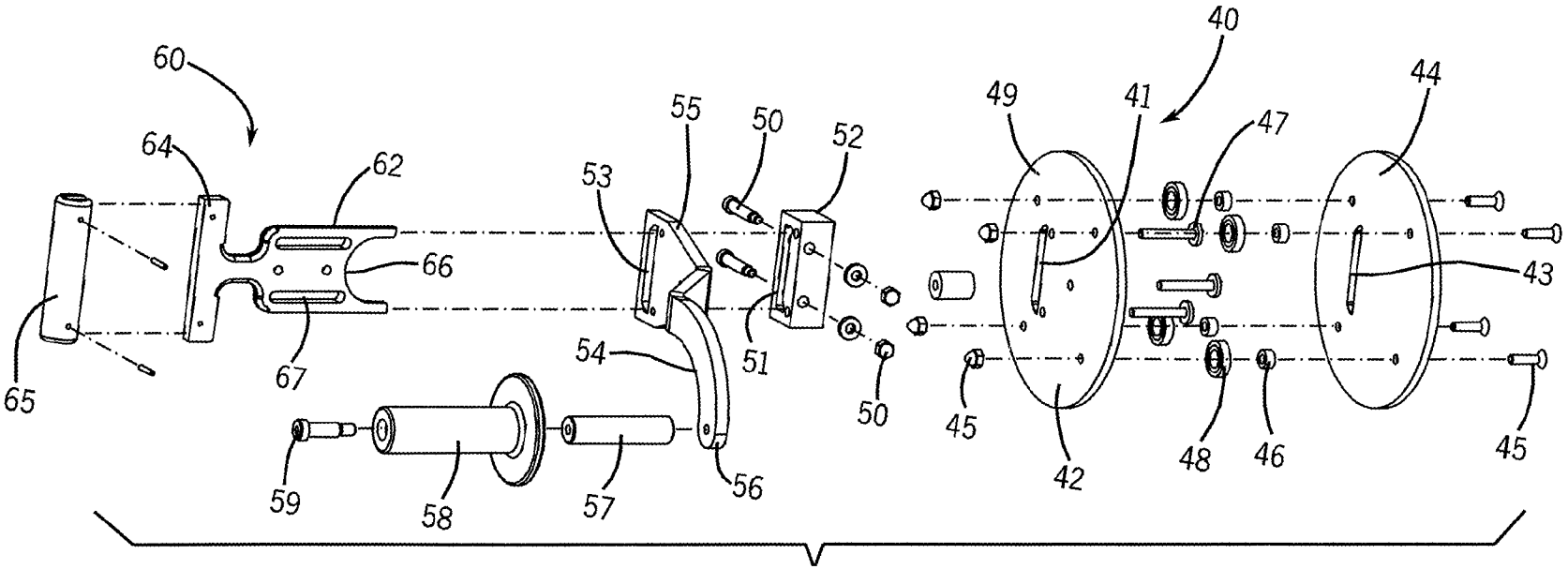
FIG. 2 is a front, top and left side exploded perspective view of the center assembly and the coupling jaw assembly of the apparatus shown in FIG. 1.

As is also shown in FIG. 2, each of the disks 42, 44 includes a slot 41, 43, respectively. When the disks 42, 44 are properly aligned, the slots 41, 43 are aligned as well. The function of the slots 41, 43 is to accommodate a portion of the coupling jaw assembly 60, as will be apparent shortly.

The handle-side face 49 of the crank side center disk 42 also has a mount 52 and a handle crank 54. The handle crank 54 comprises a proximal end 55 that is attachable to the disk 42 by means of fasteners 47, the mount 52 being disposed between the disk 42 and the handle crank 54. The handle crank 54 also comprises a distal end 56. A handle shaft 57, together with a revolving handle 58, is attached to the distal end 56 of the handle crank 54 by means of a fastener 59. In this configuration, the handle 58 is free to rotate or revolve around the shaft 57. It is to be noted that a plurality of secondary fasteners 50 are transversely insertable into the mount 52. The mount 52 further comprises a slot 51 and the proximal end 55 of the handle crank 54 further comprises a slot 53, the slots 51, 53 being aligned with the slots 41, 43 of the disks 42, 44, respectively. All of the slots 41, 43, 51, 53 are configured to receive a portion of the coupling jaw assembly 60 there through.

Figure 3:
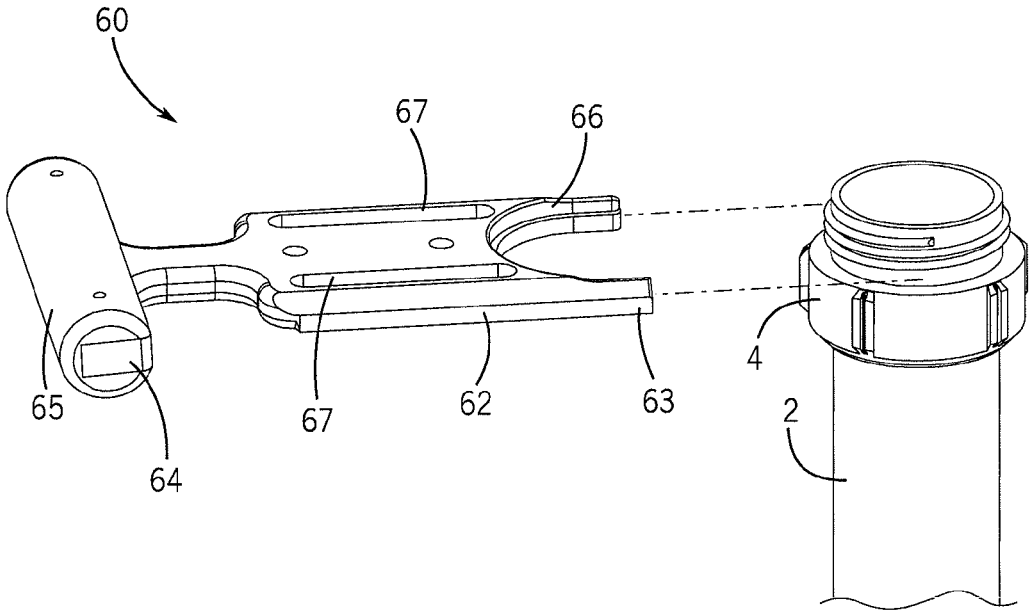
FIG. 3 is a front and top perspective view of the fork used in the coupling jaw assembly of the apparatus and showing the fork prior to engagement with the male coupling end of the hose line.
Figure 4:
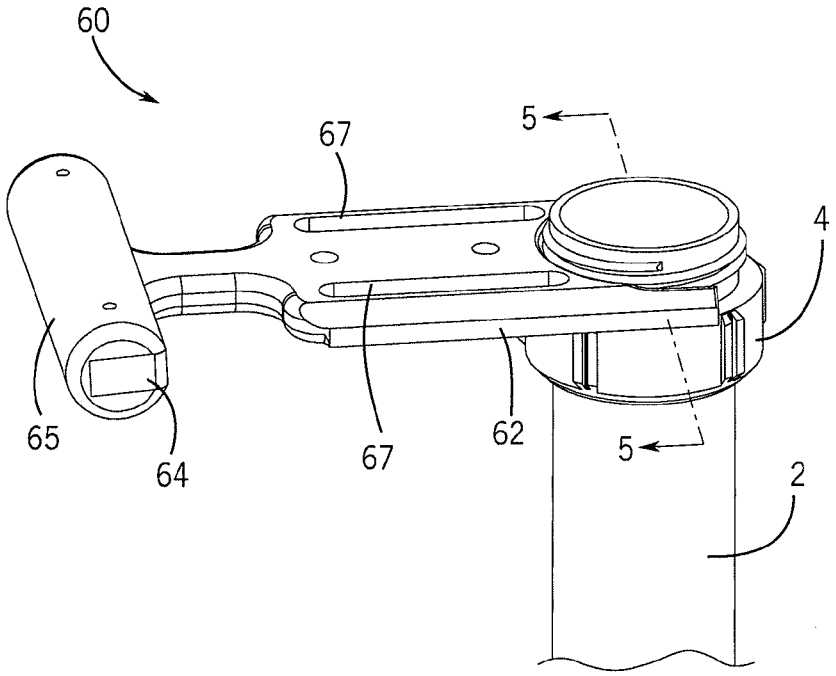
FIG. 4 is the same view illustrated in FIG. 3 but showing the fork engaged with the male coupling end of the hose line.

The coupling jaw assembly 60 comprises a substantially flat jaw body 62 having a handle 64 and a handle grip 65. The jaw body 62 comprises a leading portion having an arcuate-shaped fork 66 defined in it. That is, the fork 66 is a substantially U-shaped structure which is so configured for "capturing" a hose line end 4 as is apparent from the drawings. The jaw body 62 further comprises a pair of longitudinally-extending slots 67 such that, when the jaw body 62 is inserted into the slots 41, 43, 51, 53 of the various components of the center assembly 40, the insertion of the fasteners 50 into the mount 52 serve to limit the inward and outward movement of the jaw body 62 relative to the center assembly 40 and relative to the crank side center disk 42. This allows the fork 66 of the coupling jaw assembly 60 to engage one end 4 of the hose line 2, which is considered the "male end" of the hose line 2, when the hose line end 4 is disposed within the frame 11 of the apparatus 10. See FIGS. 3 and 4.

Referring now to FIG. 5, the engagement of the U-shaped fork 66 of the coupling jaw assembly 60 with one end 4 of the hose line 2 is shown in substantially greater detail. Specifically, it will be seen that the male hose end 4 comprises a threaded portion 6. Behind the threaded portion 6 is a short unthreaded shank 7 and a shoulder 8. This structure correlates to the cross-sectioned shape of the tips 63 of the fork 66, the fork tips 63 having an inwardly-extending rim 68 that engages the unthreaded shank 7 of the male end 4 and an outwardly-tapered portion 69 that comes in close proximity to the threaded portion 6 of the male end 4. In this configuration, the engagement of the U-shaped fork 66 with the male end 4 of the hose line 2 effectively "captures" the male end 4 within the apparatus 10 as previously mentioned.

It is to be understood that alternatively-sized forks 66 can be provided to allow the apparatus 10 to be used with alternatively-sized hose line ends 4. That is, the tips 63 of the U-shaped fork 66 may be spaced further apart or closer together, and the U-shaped portion of the fork 66 may have a larger or smaller diameter or radius than that shown and described herein without deviating from the scope of the present invention. It is also to be understood that the fork 66 can also be alternatively-configured to engage other ends of hose lines that have ends other than a male end 4. For example, a fork 66 could be configured to engage a hose line end 4 at the point where the end 4 is attached to the hose line 2. This would effectively capture another portion of the hose line end 4 and the hose line 2 could still be wound as will be described below.

In application, the apparatus 10 is intended by this inventor to be used by a fire fighter after the hose line has been drained of water and then flattened while it lay on the ground in a straight line. The user positions the apparatus 10 near one end of the hose line 2. Refer again to FIG. 1. The upper brush bar 70 and the hose guide roller 76 are elevated by pulling the spring plunger 74 from a lowermost locked position. The male coupling end 4 of the hose line 2 is fed into the frame 11 between the upper brush bar 70 and the lower brush bar 80. The male coupling end 4 is then held behind the center assembly 40 at a point where the coupling jaw assembly 60 can be inserted into center assembly 40 and the fork 66 capturing the male coupling end 4. The upper brush bar 70 can then be lowered such that the brushes 72, 82 of the brush bars 70, 80 can be used to remove debris from the hose line 2 as it is pulled into the frame 11 of the apparatus 10.

The user next lowers the kneeling plate 98 and places his or her weight onto the kneeling plate 98 using one knee. This is done to maintain the position of the apparatus 10 during winding. The user then commences the winding of the handle 58 of the center assembly 40. This, in turn, rotates the center assembly 40, including the fork 66 of the coupling jaw assembly 60 and pulls the hose line 2 into the frame 11 of the apparatus 10. As the hose line 2 is almost completely wound onto itself within the frame 11 of the apparatus 10, the user will raise the upper brush bar 70 to allow the second or female coupling end (not shown) to pass into the frame 11 to complete the winding of the hose line 2. When completed, the hose line 2 is completely coiled within the frame. At this point, the user can carry the apparatus 10 with the coiled hose line 2 to a location and/or pull the coupling jaw assembly 60 from the center assembly 40 which releases the coiled hose line 2. With the bottom of the apparatus 10 being open, the apparatus 10 can be raised and the coiled hose line 2 stays in position.

Based upon the foregoing, it will be apparent that there has been provided a new, useful and non-obvious apparatus for facilitating the removal of water from an hose line after the hose line has been used in a fire fight; which apparatus can also be used to transport a coiled hose line from the drain site to the fire truck onto which the hose line must be re-stacked; and which apparatus can be used to transport hose line of different diameters.

The principles of this invention having been fully explained in connection with the foregoing, I hereby claim as my invention:

1. An apparatus for hand winding a hose line of the type used in fire fighting, said hose line having a threaded male end, the apparatus comprising:

a frame, said frame comprising a first side plate, a second side plate and a plurality of cross blocks disposed between the side plates to position the plates apart from each other; said first side plate comprising a circular aperture, an outer crank side and an inner hose side;

a center assembly comprising a handle crank, a revolving handle, a crank side center disk, a hose side center disk, means for positioning the disks apart from each other and means for allowing rotation of the disks about the circular aperture of the first side plate, the center assembly being rotated about the first side plate aperture by rotation of the handle crank; and a coupling jaw assembly comprising a flat jaw body, the flat jaw body being slidable within the center assembly and the flat jaw body comprising a fork for alternatively capturing the threaded male end of the hose line within the fork when the flat jaw body is slid inwardly of the outer crank side of the first side plate and to a position between the side plates and then releasing the threaded male end from the fork when the flat jaw body is slid outwardly of the inner hose side of the first side plate; the flat jaw body and the fork also being rotated about the first side plate aperture by rotation of the handle crank;

wherein rotation of the handle crank winds the hose line to form a coiled hose between the side plates; and wherein sliding of the flat jaw body outwardly from between the side plates releases the threaded male end of the hose line from the fork and allows the frame to be lifted from the wound hose line.

2. The apparatus of claim 1 wherein the disks comprise aligned slots defined in the disks.

3. The apparatus of claim 2 wherein the crank side center disk further comprises a handle side face and a handle crank mount and wherein the handle crank and the handle crank mount further comprise aligned slots defined in them, such slots being aligned with the slots defined in the disks.

4. The apparatus of claim 3 wherein the flat jaw body further comprises a handle and a handle grip, the flat jaw body being receivable within the slots of the handle crank, the handle crank mount and the disks.

5. The apparatus of claim 4 further comprising means for limiting the inward and outward movement of the flat jaw body relative to the frame.

6. The apparatus of claim 1 wherein the fork comprises a U-shaped structure having fork tips that are configured to engage the male end of the hose line.

7. The apparatus of claim 6 wherein the male end of the hose line comprises a threaded portion, an unthreaded shank and a shoulder and wherein the fork tips each have an inwardly-extending rim that engages the unthreaded shank of the male end of the hose line between the threaded portion and shoulder of the male end of the hose line.

8. The apparatus of claim 7 wherein alternatively-sized U-shaped structures may be provided to accommodate alternatively-sized hose line ends.

9. The apparatus of claim 1 wherein each side plate further comprises a pair of feet for supporting the frame in an upright position.

10. The apparatus of claim 1 further comprising a kneeling plate.

11. The apparatus of claim 1 wherein the frame comprises a bottom and wherein the bottom of the frame is open such that the frame can be lifted from the coiled hose line when the fork of the coupling jaw assembly is retracted from the male end of the coiled hose line.

12. The apparatus of claim 1 wherein the frame further comprises an upper brush bar and a lower brush bar for removing debris from the hose line as it is pulled into the frame of the apparatus.

13. The apparatus of claim 1 wherein the hose line has an end that is not a threaded male end and the fork of the coupling jaw assembly is configured to capture such end.

14. The apparatus of claim 1 further comprising a lift strap.

* * * * *